US005405253A

United States Patent [19]

McLaren

[11] Patent Number: 5,405,253

[45] Date of Patent: Apr. 11, 1995

[54] ROTARY VANE GAS COMPRESSORS

[75] Inventor: Robert J. L. McLaren, Hereford, Great Britain

[73] Assignee: Rotocold Holdings Limited, Hereford, United Kingdom

[21] Appl. No.: 193,481

[22] Filed: Jan. 14, 1994

[30] Foreign Application Priority Data

Jul. 16, 1991 [GB] United Kingdom ..... 9115368

[51] Int. Cl.[6] ..... F01C 21/04

[52] U.S. Cl. ..... 418/1; 418/98

[58] Field of Search ..... 418/1, 76, 83, 87, 97

[56] References Cited

U.S. PATENT DOCUMENTS 4,553,906 11/1985 Boller et al. ..... 418/97
4,923,377 5/1990 Cavalleri ..... 418/98

FOREIGN PATENT DOCUMENTS 0284712 10/1988 European Pat. Off. .
2544025 10/1984 France .
466105 10/1928 Germany .
371287 4/1932 United Kingdom .
420501 12/1934 United Kingdom .
2131092 6/1984 United Kingdom .
2167130 5/1986 United Kingdom .
2257751 1/1993 United Kingdom .
569749 9/1977 U.S.S.R. .
86/05242 9/1986 WIPO .

*Primary Examiner*—Richard A. Bertsch
*Assistant Examiner*—Charles G. Freay

[57] ABSTRACT

A rotary compressor includes a stator (2) having an inlet (3) and an outlet (4) for gas to be compressed, a rotor (5) within the stator (2) and vanes (7) being present to define cells (C) to transport gas from the inlet (3) to the outlet (4). According to the invention a supplementary passage (11) is present in the end wall (10) to direct gas from a region of high pressure (A) towards a region of lower pressure (B) thereby allowing lubricant to reach the region of high pressure gas.

5 Claims, 1 Drawing Sheet

ROTARY VANE GAS COMPRESSORS

Figure 1:
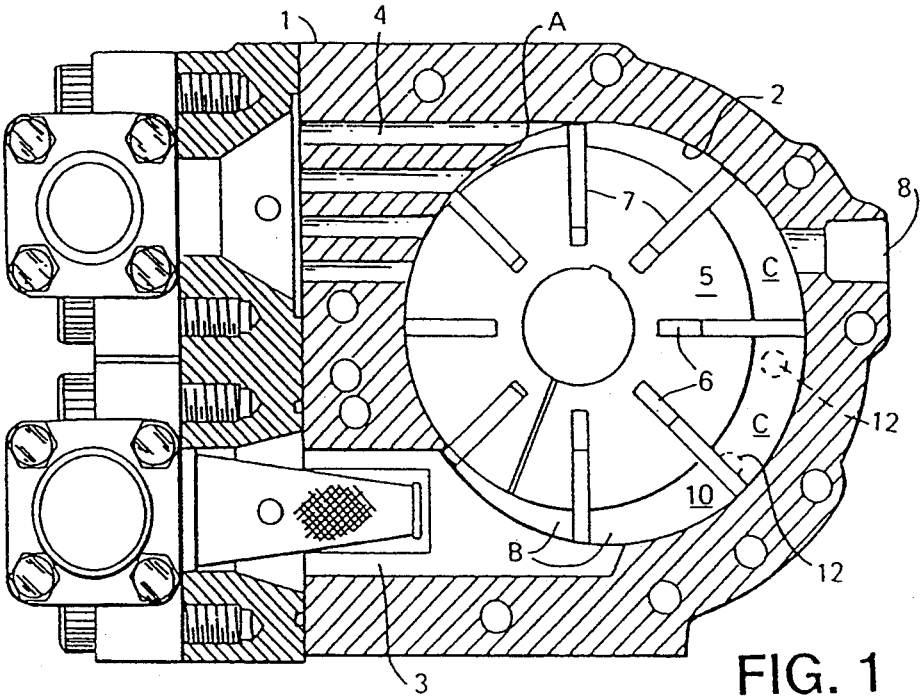

The invention relates to rotary vane gas compressors. In particular, the invention relates to such compressors comprising a stator containing a multivaned rotor arranged to define a succession of cells in which a gas, typically a refrigerant gas, is expanded and compressed in its travel from the inlet to the outlet. The vanes may be arranged to slide in radial slots set in the rotor.

All rotary compressors, including the sliding vane type, depend on an oil film to seal the gap between the moving parts. This becomes increasingly important as the compression ratio increases. In most cases oil at discharge pressure is fed into the compressor from an oil/gas separator through which gas from the compressor is discharged before entering the system. The oil is usually fed via bearing cavities from whence it flows through the gap between rotor faces and the end walls to reach and lubricate all the other parts of the compressor.

It is one object of the invention to improve rotary compressors and in particular the volumetric efficiency thereof.

According to the invention in one aspect there is provided a rotary compressor comprising a stator having an inlet and an outlet for gas to be compressed, a rotor located within the stator, vanes being radially spaced apart and extending from the rotor to define cells to transport gas from the inlet to the outlet characterised in that a passage in the end walls facing the ends of the rotor is present to direct gas from a region where the gas is under high pressure towards a region of lower pressure, thereby allowing lubricant to reach the region of high gas pressure.

A gap of the order of 0.05 to 0.07 mm is present between each end wall of the stator and the opposite end face of the rotor. This gap must be well sealed with oil otherwise the gas leakage across the faces from a high to a low pressure side will be serious. During its passage through the compressor the oil will naturally tend to flow toward the regions of lowest pressure. Oil will not freely flow to regions of higher pressure such as exists near the discharge port. Where the pressure is highest there will be little lubricant and in consequence much oil will flow in the region of low pressure. The invention is based on the realisation that there will be a risk of shortage of oil for sealing in the region of high pressure and that such shortage can have serious consequences on performance because gas leaking across the rotor faces and entering the inlet cell will reduce the volume of external gas entering the compressor. By directing high pressure gas obstructing the flow of lubricant away from the high gas pressure region this problem is reduced or avoided.

One end of the passage is in the region of high gas pressure and the other end can be located to emerge at any compression cell where the gas pressure will be lower. The passage may have one or more outlets. Volume or pressure control means, e.g. a flow restrictor, may be present in the passage.

We are aware that it is known to provide passages to direct high pressure gas to avoid exceeding the predetermined capacity of a compressor but such passages are not located in the end walls and arranged to ensure the proper flow of lubricant throughout the compressor.

Figure 3:
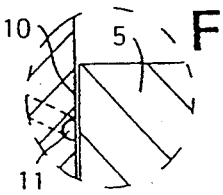
Figure 3A:
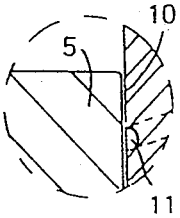
Figure 2:
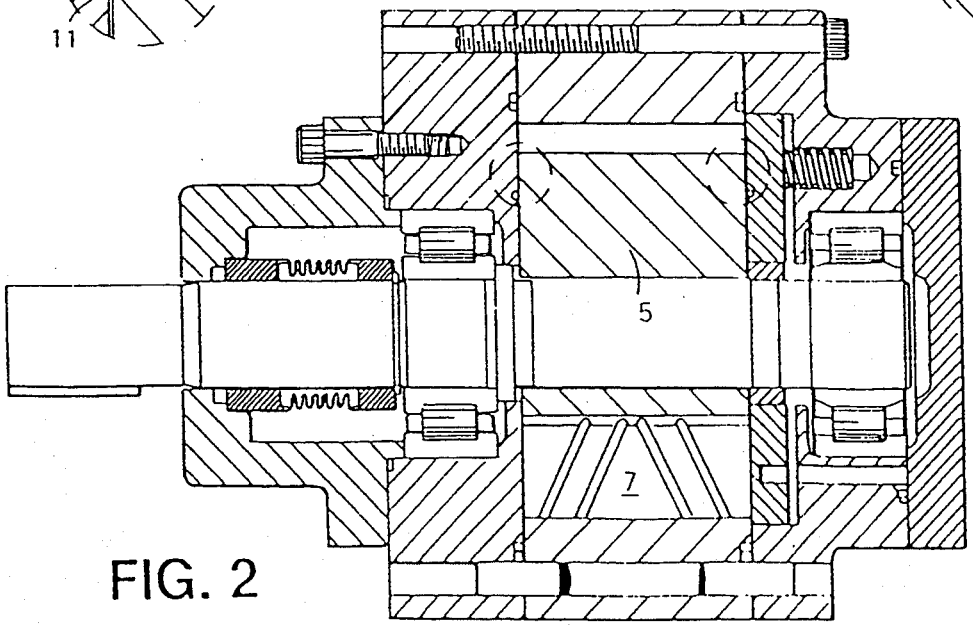

In order that the invention may be well understood it will now be described by way of example only with reference to the accompanying diagrammatic drawings, in which FIG. 1 is a transverse section through a multivaned rotary compressor; and FIG. 2 is a longitudinal section; and FIG. 3 is an enlarged view showing an end wall and the facing rotor; and FIG. 3*a* is an enlarged view showing an end wall and the facing rotor.

The compressor comprises a housing 1 including a circular or non-circular stator profile 2 defining a compression chamber. A suction port 3 communicates with one side of the profile and a discharge port 4 with the other. The chamber contains a rotor 5 having a plurality of radially spaced apart slots 6, movable vanes 7 being present in the slots. The vanes define cells C in co-operation with the facing wall of the profile 2 and the end walls 10. The refrigerant gas is transported from the inlet 3 to the outlet 4 in these cells. Because of the profile the gas is compressed in its journey from the inlet to the outlet. An auxiliary gas injection port 8 is present opposite the inlet 3 and the outlet 4.

According to the invention at least one auxiliary passage 11 is present in the end wall 10, to define a pathway located and arranged to lead gas under high pressure from the region A to the region B. The passage 11 may take the form of a hole about 3 mm in diameter. The pressure in region A at the inlet or collection end of the passage 11 being much higher than at another position B will cause gas to flow from region A and drop the pressure in that region. This will allow oil to flow much more freely in this area and significantly reduce the gas leakage.

The position and size of passage 11 can be varied to suit individual operating conditions. The essential requirement is that gas, with some oil, is led from the collection opening of passage 11 in each end wall 10 and fed into one of the compression cells B or C, through outlets 12 of passage 11, in a position where the pressure is significantly lower than the pressure at the collection point.

The improvement in volumetric efficiency of the compressor arising from the presence of the passage(s) 11 increases more or less proportionally as the compression ratio increases. On refrigeration applications in the low temperature region, improvements of 30% or more are possible.

I claim:

1. A rotary compressor including a stator having an inlet and an outlet for gas to be compressed, the stator having end walls, a rotor located within the stator, vanes being radially spaced apart and extending from the rotor to define cells to transport gas from the inlet to the outlet, wherein a passage is present within each end wall facing the ends of the rotor to direct gas from a region where the gas is under high pressure towards a region of lower pressure, thereby allowing lubricant supplied to the compressor to reach the region of high gas pressure and flow therein.

2. A compressor according to claim 1, wherein the passage has one or more outlets.

3. A compressor according to claim 1, wherein a gap of the order of 0.05 mm to 0.07 mm is present between each end wall of the stator and the opposite end walls of the rotor.

4. A method of compressing gas in a rotary compressor including a stator having an inlet and an outlet for gas to be compressed, a rotor located within the stator, vanes being radially spaced apart and extending from the rotor to define cells to transport gas from the inlet to the outlet, including the step of diverting gas from a high pressure region towards a region of lower pressure through a passage within each end wall facing an end of the rotor, thereby allowing lubricant introduced into the compressor to reach the region of high pressure.

5. A method according to claim 4, including the step of providing each passage with one or more outlets.

* * * * *